United States Patent [19]

Ireland

[11] Patent Number: 4,584,587

[45] Date of Patent: Apr. 22, 1986

[54] TUNEABLE ANTENNA WITH INDUCTIVE COUPLING AT INPUT

[76] Inventor: Frank E. Ireland, 7425 SW. 34th St., Miami, Fla. 33155

[21] Appl. No.: 528,898

[22] Filed: Sep. 2, 1983

[51] Int. Cl.[4] ..... H01Q 9/24; H01Q 1/48

[52] U.S. Cl. ..... 343/745; 343/861

[58] Field of Search ..... 343/715, 749, 750, 861, 343/745

[56] References Cited

U.S. PATENT DOCUMENTS 4,117,493 9/1978 Altmayer ..... 343/750

4,180,819 12/1979 Nakano ..... 343/792

4,360,814 11/1982 Wells ..... 343/750

*Primary Examiner*—Eli Lieberman

*Attorney, Agent, or Firm*—Malin, Haley, McHale

[57] ABSTRACT

A whip antenna system for surface vehicles or the like. The antenna system's tuner has an LC tank circuit, into whose inductor is inserted a coil that is connected to the vehicle's transmitter/receiver, the coil being field coupled to the tank circuit's inductor. The inserted coil provides sufficient reactance that the vehicle need not serve as a counterpoise, thus providing an antenna of comparable size but electrically less close to the ground (i.e. one that has better "seeing"), and useable with non-metallic vehicles (e.g. fiberglass boats).

1 Claim, 6 Drawing Figures

TUNEABLE ANTENNA WITH INDUCTIVE COUPLING AT INPUT

BACKGROUND OF THE INVENTION

Prior art whip antennae for small vehicles, such as automobiles or small marine craft, typically are electrically connected to the vehicle, using the vehicle's metallic body as part of the radiating system. Such antennae have several disadvantages. These antennae cannot be used separate from a metallic vehicle or other structure capable of providing the requisite electrical counterpoise. Moreover, were the antenna to break, the vehicle would lose communication entirely. Finally, because the vehicle is part of the radiating system, the system as a whole has poor "seeing," i.e. elevation above the horizon.

An improvement over such prior art antennae is shown in U.S. Pat. No. 3,474,453 to the instant inventor, the disclosure of which is incorporated herein by reference. This patent shows two antenna portions 11, 15 connected by tuner 25, the tuner being a tank circuit trimmed by a variable capacitor. The electromagnetic parameters of the antenna system are selected so that, at desired transmission frequencies, each antenna portion and the tuner has an electrical length of one-quarter wavelength. The vehicle itself is electrically connected to the antenna, and is itself part of the antenna system, having an electrical length of one-quarter wavelength.

SUMMARY OF THE INVENTION

Accordingly, it is an object of the invention to provide an improved antenna suited to use on non-metallic vehicles, or otherwise operative without an additional electrical counterpoise.

Another object of the invention is to provide a whip antenna system that, if broken, does not cause blackout of communication.

Another object of the invention is to provide a whip antenna for surface vehicles with improved "seeing."

Another object of the invention is to provide such an antenna system that is simple and inexpensive.

In accordance with these and other objects which will be apparent hereinafter, there is provided an antenna system having a tuner, that is, an impedence matching device, similar to that disclosed in abovementioned U.S. Pat. No. 3,474,453, but improved thereover. Like the prior antenna, the instant antenna has a support member about which is wound a copper strip to form an inductive winding, and about this strip is located a sleeve movable along the winding to cover and uncover the strip. The sleeve thus provides a distributed capacitance, and is in electrical parallel with the inductive coil, forming a quarter wave matching stub or tunable tank circuit. However, the support member of the instant antenna system is hollow. Within the strip and support member is inserted another inductive winding, which is fed directly by the vehicle's transmitter. The second winding is field coupled to the first winding, and the additional impedence due to the insert provides an antenna of about one wavelength electrical length at VHF along a mechanical length comparable to conventional prior art counterpoised whip antennae. Thus, the antenna system as a whole is further from the ground and has better "seeing." The insert coil is selected such that the tuner and whip each have electrical length of one-half wavelength at desired transmission frequencies. Thus, were the whip to break off, the tuner itself would still constitute an operative one-half wavelength antenna.

The novel features of the invention, as well as its organization and best mode presently contemplated for practicing it, will be best understood from the following description read in conjunction with the accompanying drawing figures wherein:

DESCRIPTION OF PREFERRED EMBODIMENT

Figure 1:
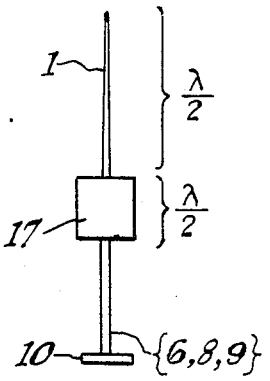
FIG. 1 is a schematic of the antenna system, illustrating the electrical lengths of the whip antenna and tuner.
Figure 3:
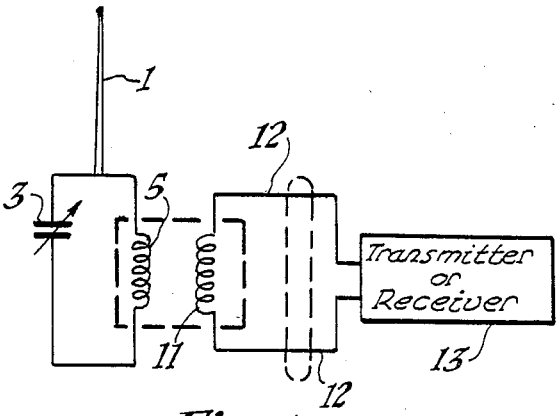
FIG. 3 is circuit schematic of the tuner of the instant invention.
Figure 2:
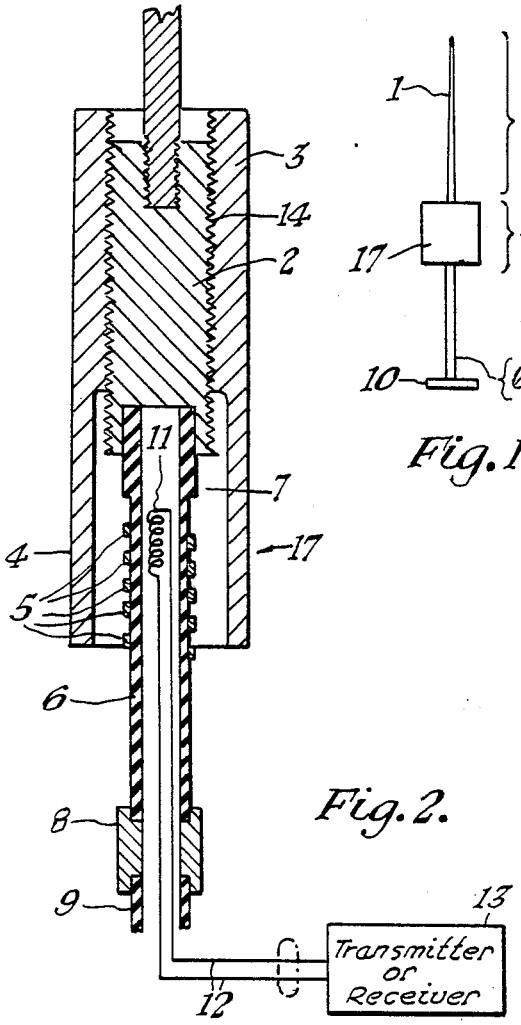
FIG. 2 is a sectional view through the center of the tuner of the instant invention.

The invention will now be particularly described, with special reference to drawing FIGS. 1–3.

Whip antenna 1 attaches to tuner 17 by screwing the whip's base into cylindrical metal member 2. Tuning sleeve 3 locates over, and screws onto, member 2. Skirt 4 of sleeve 3 projects over copper strip 5. Strip 5 is unitary, and is wound helically around cylindrically hollow support pole 6. Pole 6 can be of any suitable electrical insulator that provides sufficient mechanical support for whip 1, for example fiberglass or rigid plastic. Strip 5 is in electrical contact with cylindrical metal member 3, as shown at 7. Members 2, 8 act as ferrules for the opposite ends of support pole 6, and the top open end of another cylindrically hollow support pole 9 is similarly attached to member 8, as shown in FIG. 2. The bottom of support pole 9 is fixed in mounting means 10 on the vehicle itself.

Within the hollow interior of support pole 6 is placed inductive winding 11, which is connected by coaxial cable 12 to transmitter or receiver 13. (It is irrelevant whether member 13 be a transmitter or receiver, as the characteristics of any antenna are identical in both transmission and reception, as is understood by workers skilled in the antenna art.)

As can be seen by FIG. 2 and the foregoing, sleeve 3 constitutes a capacitance distributed along the length of pole 6. Wound copper strip 5 consititutes an inductive winding in electrical parallel with capacitor-sleeve 3, and together strip 5 and sleeve 3 constitute a tank circuit. The tank circuit can be tuned by rotating sleeve 3, i.e. causing sleeve 3 via screw threads 14 to move up or down along the axis of symmetry of pole 6, thereby covering more or less of pole 6, and thereby providing more or less capacitance to the tank circuit. Inductive winding 11 is field coupled to the field within coil 5, and provides the additional reactance necessary to enable the antenna system to tune without a counterpoise. Alternative ways of viewing the function of insert coil 11 is that it provides sufficient additional reactance to impedence match the antenna, or that the insert provides the electrical length (counterpoise) that corresponds to the vehicle body in prior antenna systems of this type. The parameters of the tuner should be selected so that, when the antenna system is tuned to a desired communication frequency, the electrical length of the whip and tuner are equal, and equal to one-half wavelength each. If so, tuner 11 itself would be an operative radiator at such frequency, and could provide communication capacity even were whip 1 to break off, or be otherwise removed.

Such an antenna system is particularly useful at communication frequencies.

Figure 5:
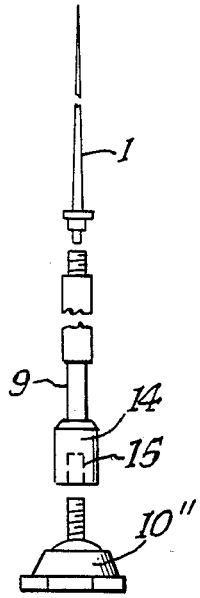
FIGS. 5–6 show various alternative means for mounting the antenna system.
Figure 6:
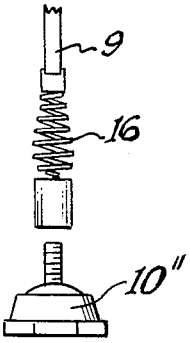
Figure 4:
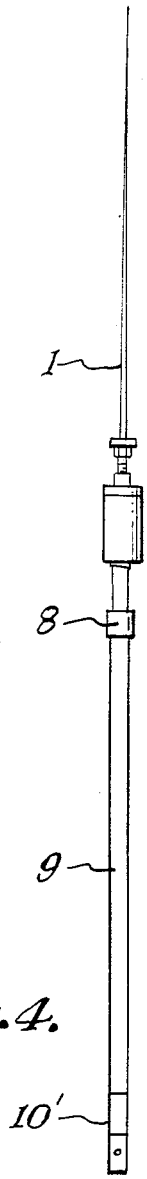
FIG. 4 is an elevational view of the antenna system of the instant invention, illustrating a means for mounting the antenna system.

FIGS. 4–6 show various mounting means for the antenna system. FIG. 5 shows support pole 9 inserted in sleeve bracket 10'. Bracket 10' could be, for example, screw mounted to a convenient surface on a vehicle, and pole 9 slid into bracket 10' and fixed in any suitable manner.

FIG. 5 shows an alternative mounting means. Pole 9 is inserted into one end of ferrule 14, ferrule 14 being provided with a screw threaded cavity which can screw onto conventional mounting base 10''. FIG. 6 shows a similar scheme, save that the bottom of the antenna system is provided with spring 16 to give the system added mechanical flexibility.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A voltage feed half wave or multiple of a half wave antenna system for use on nonconductive or conductive counterpoise comprising:

a quarter wave matching stub including a tuned or tuneable capacitance and inductance in parallel, said capacitance comprising a skirt around said inductance;

said quarter wave matching stub connected to one end of said half wave radiator to supply operating voltage; and an inductance coupling means for inductance coupling of said quarter wave matching stub to transfer voltage, said inductance coupling means mounted within said inductance and connectable to a transmitter or receiver.

* * * * *